US008763621B2

(12) United States Patent
Jin

(10) Patent No.: US 8,763,621 B2
(45) Date of Patent: Jul. 1, 2014

(54) MULTI-FUNCTIONAL INSTANT TENT

(76) Inventor: Ki Ho Jin, Rongshen New City (CN)

( * ) Notice: Subject to any disclaimer, the term of this patent is extended or adjusted under 35 U.S.C. 154(b) by 0 days.

(21) Appl. No.: 13/347,828

(22) Filed: Jan. 11, 2012

(65) Prior Publication Data

US 2013/0174883 A1 Jul. 11, 2013

(51) Int. Cl.

| | |
|---|---|
| ***E04H 15/64*** | (2006.01) |
| ***E04H 15/54*** | (2006.01) |
| ***E04H 15/42*** | (2006.01) |
| ***E04H 15/32*** | (2006.01) |

(52) U.S. Cl.
USPC ..... 135/119; 135/115; 135/156; 135/120.3; 135/126

(58) Field of Classification Search
USPC ..... 135/115, 119, 120.3, 156, 124, 126
See application file for complete search history.

(56) References Cited

U.S. PATENT DOCUMENTS

| | | | | |
|---|---|---|---|---|
| 4,193,413 | A * | 3/1980 | Watts et al. | 135/98 |
| 4,827,958 | A * | 5/1989 | Cantwell et al. | 135/127 |
| 5,421,355 | A * | 6/1995 | Cantwell | 135/120.3 |
| 6,021,795 | A * | 2/2000 | Long et al. | 135/98 |
| 6,681,786 | B2 | 1/2004 | Ju | |
| 2006/0272695 | A1 * | 12/2006 | Mettavant | 135/126 |
| 2008/0190473 | A1 * | 8/2008 | Mettavant | 135/126 |

* cited by examiner

*Primary Examiner* — David R Dunn
*Assistant Examiner* — Danielle Jackson
(74) *Attorney, Agent, or Firm* — John H. Choi

(57) ABSTRACT

The present invention provides a multi-functional instant tent collapsible from an open configuration to a collapsed configuration. The instant tent comprises an instant set-up frame which is coupled to an outer surface of a rain fly. An inner surface of the rain fly is detachably coupled to an outer surface of an enclosed inner tent. The instant tent is configured such that the frame, rain fly and inner tent remain coupled together in the collapsed configuration in a compact state for easy storage and transport. In the open configuration, the instant tent could be used as an enclosed shelter when the inner tent and rain fly are attached to each other, and as an open shelter when the inner tent is detached and removed from the instant tent.

15 Claims, 6 Drawing Sheets

FIG. 8
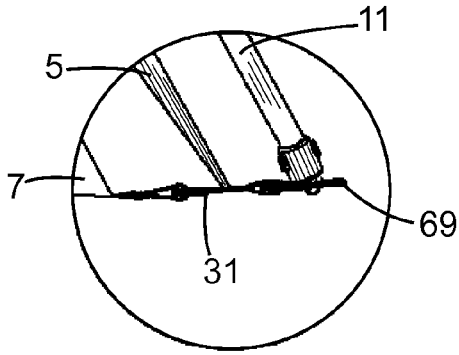
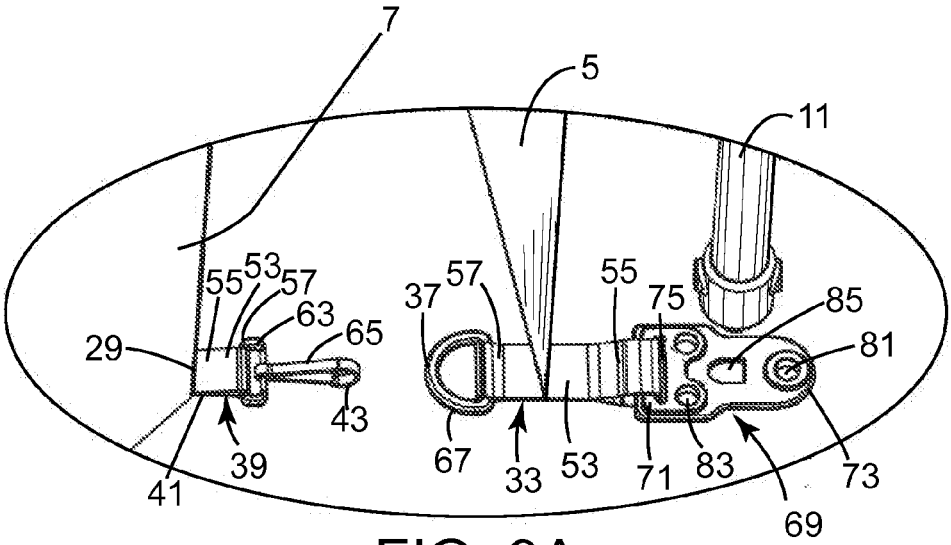
FIG. 9A
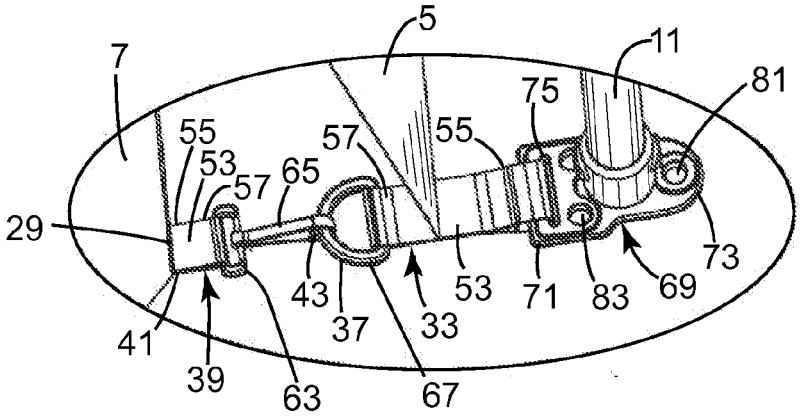
FIG. 9B

MULTI-FUNCTIONAL INSTANT TENT

BACKGROUND OF THE INVENTION

1. Field of the Invention

The present invention relates to a foldable or collapsible tent, and more particularly to a multi-functional instant tent for separate uses as an enclosed tent as well as an open shelter while maintaining ease in opening and collapsing the instant tent.

2. Description of Prior Art

For novice campers and camping families, among others, foldable tents are a popular alternative to conventional assemble-to-use tents. Foldable tents, which are commonly referred to as "instant tents," "one-touch tents" or "pop-up tents," are sold preassembled, making opening and closing of the tent easy and less time consuming. Thus, the demand (and prices) for instant tents have increased. Along with the demand increase, campers have developed higher expectations for the features of instant tents.

One essential feature of instant tents is protection from weather elements. Tents are manufactured by attaching several sections of tent cloth and thus seams are formed between adjoining sections. Even though the seams are reinforced (often with weather-proof tape), leakage may occur, especially during severe weather conditions. Therefore, a rain fly is necessary to cover the seams and to provide the tent with additional protection from weather elements such as rain and snow.

A rain fly is also required for instant tents having ceilings constructed with permeable fabric for increased ventilation. In this instance, the rain fly not only covers the seams of the tent to prevent leakage, but it also protects the top portion of the tent from inclement weather.

There are also other uses for rain flies. Rain flies provide additional shade for the tent to prevent temperatures of the tent interior from rising to uncomfortable levels.

Some instant tents are sold with a separate rain fly. These rain flies are separately installed and secured on an outer portion of the tent frame after the instant tent is fully opened and set up for use. Moreover, the rain fly must be disassembled before folding the tent. These extra steps are time consuming and cumbersome for the user.

A newer design of an instant tent, as shown in U.S. patent application Ser. No. 13/295,396 (filed on Nov. 14, 2011), provides a rain fly integral to the instant tent. In this design, separate poles are dedicated to supporting the rain fly so that the inner tent and rain fly can be collectively opened and folded during operation. Even though the new design does not require separate installation of the rain fly, manufacturing costs are increased due to the additional poles required to support the rain fly which results in increased cost to the consumer.

With either of rain flies described above, however, the use of the rain fly is one-dimensional. That is, it can only be used as a rain fly in the traditional sense—to provide the tent with additional protection from weather elements. However, it would be desirable to the consumer if the rain fly could serve multiple functions. The product described in U.S. Pat. No. 6,681,786 (issued on Jan. 27, 2004) ("the '786 patent"), attempts to do just that. In the '786 patent, an instant tent is provided with a detachable inner tent and a separate rain fly. After the instant tent is opened, the inner tent can be detached from the frame and the rain fly can be separately installed over the frame to form an open shelter. Even though the instant tent of the '786 patent provides multiple uses of the rain fly, it is cumbersome for the user because the user is still required to separately install the rain fly—a time-consuming and difficult task especially when the frame is large.

Thus, if a user desires an easily erectable open shelter (i.e., a shelter with one-touch capability), the instant tents of the prior art cannot be used. Instead, she must separately purchase a one-touch or instant shelter. Instant shelters (also known as "instant canopies") are available in the market and are popular for recreational use. Much like instant tents, these shelters are sold preassembled, making opening and closing of the shelter easy and less time consuming. They provide shade and generally provide protection from non-severe weather conditions such as light rain. However, in more severe conditions an enclosed setting such as a tent is desired. Thus, instant shelters alone are not viable for multi-purpose use.

OBJECTS AND SUMMARY OF THE INVENTION

The present invention is intended to overcome at least the above-described disadvantages and to provide further improvements to instant tents in the prior art. The objects and advantages of the present invention, more specifically, are to provide a multi-functional instant tent that can be used as a safe and comfortable quarters on one hand, and an open shelter on the other hand, while maintaining ease in opening and folding the instant tent as a whole.

For achieving the above-mentioned objects, the present invention provides a one-touch frame with a rain fly attached thereto and an enclosed inner tent detachably attached to the rain fly to form a multi-functional instant tent and shelter. The multi-functional instant tent is opened with the frame, rain fly and inner tent attached together allowing the user to quickly set up the tent and rain fly collectively and simultaneously without further assembly. If the user desires to use the instant tent as an open shelter, the user could detach and remove the inner tent without affecting the other components (i.e., the frame and the rain fly) of the instant tent. The user can easily re-attach the inner tent to the rain fly and collectively collapse the instant tent into a compact state for easy storage and transport.

More specifically, in one embodiment, the present invention provides a multi-functional instant tent collapsible from an open configuration to a collapsed configuration. The instant tent comprises a frame having a central hub and a plurality of poles extending from the central hub. The instant tent also comprises a rain fly having an inner surface and an outer surface. The outer surface of the rain fly is coupled to the frame by a plurality of pole engaging assemblies. The instant tent further comprises an inner tent having an inner surface and an outer surface. The outer surface of the inner tent is detachably coupled to the inner surface of the rain fly by a plurality of coupling assemblies. The inner surface of the inner tent defines an enclosed interior of the inner tent. The frame, rain fly and inner tent remain coupled together in the collapsed configuration, and the rain fly and inner tent are detachable for multi-purpose use in the open configuration.

In another embodiment, the instant tent comprises a frame having a central hub and a plurality of poles extending from the central hub. The instant tent further comprises a rain fly having an inner surface and an outer surface. The rain fly comprises a plurality of sections fixedly attached together to form a first set of seams. The poles of the frame are coupled to the outer surface of the rain fly along the first set of seams. The instant tent further comprises an inner tent having an inner surface and an outer surface. The inner tent comprises a plurality of sections fixedly attached together to form a second set of seams. The inner surface of the inner tent defines an enclosed interior of the inner tent and the outer surface of the inner tent is detachably coupled to the inner surface of the tent fly along opposing first and second sets of seams by a plurality of coupling assemblies. The frame, rain fly and inner tent remain coupled together in the collapsed configuration, and the rain fly and inner tent are detachable for multi-purpose use in the open configuration.

In another embodiment, the present invention provides an apparatus for detachably coupling an inner tent and a tent fly of an instant tent. The apparatus comprises a first coupling member and a second coupling member. Each of the first and second coupling members have a first end and a second end. The first coupling member first end is coupled to the tent fly and the second coupling member first end is coupled to the inner tent. The second ends of the first and second coupling members are adapted to be detachably connected to each other. The rain fly and inner tent remain coupled together in a collapsed configuration, and the rain fly and inner tent are detachable for multi-purpose use in an open configuration.

BRIEF DESCRIPTION OF THE DRAWINGS

FIG. 8 is a side view of yet another coupling assembly connecting bottom portions of the frame, rain fly and inner tent of the multi-functional instant tent of FIG. 1, which is denoted "B" in FIG. 1;

FIG. 9A is a perspective view of the coupling assembly of FIG. 8 in a disengaged state;

FIG. 9B is a perspective view of the coupling assembly of FIG. 8 in an engaged state;

DETAILED DESCRIPTION OF THE PREFERRED EMBODIMENTS

Figure 1:
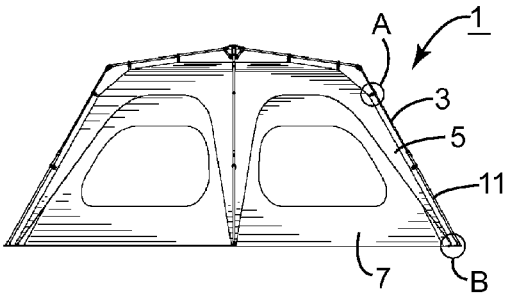
FIG. 1 is a side view of the multi-functional instant tent of the present invention in an open configuration.
Figure 2:
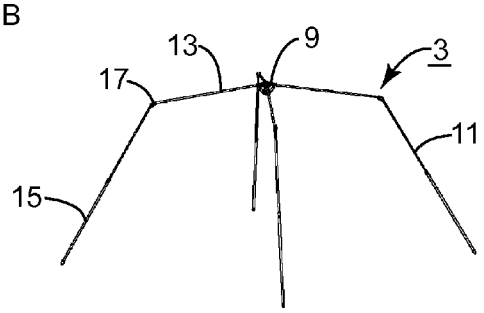
FIG. 2 is a perspective view of the frame of FIG. 1.
Figure 3:
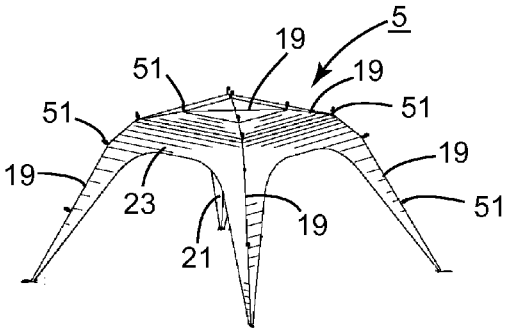
FIG. 3 is a perspective view of the rain fly of FIG. 1.
Figure 4:
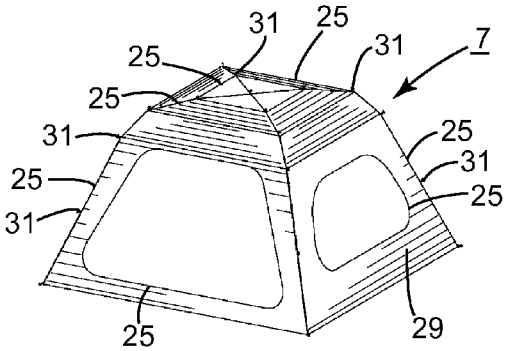
FIG. 4 is a perspective view of the inner tent of FIG. 1.
Figure 13:
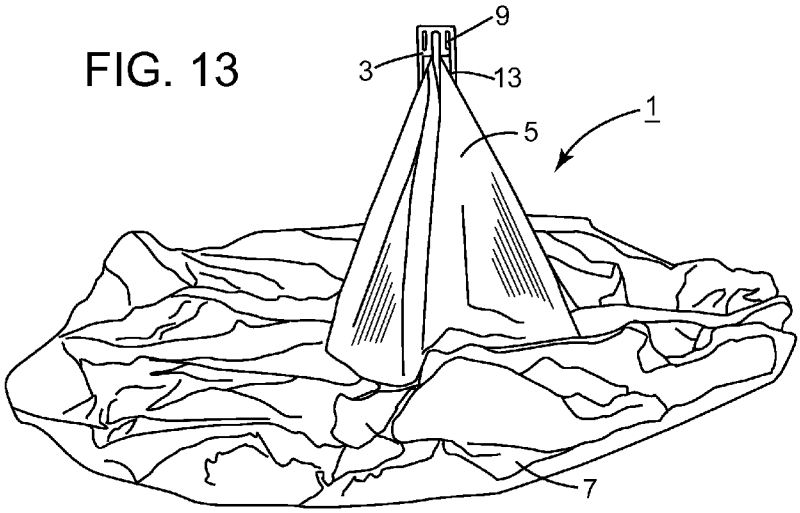
FIG. 13 is a perspective view of the multi-functional instant tent of FIG. 1 in a partially collapsed configuration.

Referring to FIG. 1, a multi-functional instant tent 1 of the present invention is shown. The instant tent 1 comprises a frame 3 as shown in FIG. 2, a rain fly 5 as shown in FIG. 3 and an inner tent 7 as shown in FIG. 4. The frame 3, rain fly 5 and the inner tent 7 are coupled together where the rain fly 5 is positioned radially inward from the frame 3, and the inner tent 7 is positioned radially inward from the rain fly 5. The frame 3, rain fly 5 and inner tent 7 are collectively opened or erected to an open configuration as shown in FIG. 1, and also collectively folded or collapsed to a collapsed configuration as shown in FIG. 13 (shown partially collapsed) and FIG. 14 (only frame shown), without requiring assembly or disassembly of any parts.

Referring to FIG. 2, the frame of the instant tent 3 is a one-touch type or instant tent frame comprising a central hub 9 and a plurality of extendable and foldable poles 11 pivotally attached to the central hub 9. In the preferred embodiment, the one-touch frame is that of the type described in U.S. Pat. No. 7,861,736 (issued on Jan. 4, 2011) which is incorporated by reference in its entirety. The central hub 9 of the one-touch frame 3 includes a movable lower base portion with a hollow, enclosed shaft extending upwardly therefrom. The shaft is movable within an upper hub portion. A biasing member is housed within the shaft and facilitates the opening and closing of the frame 3. The forces exerted on the poles 11 from the biasing member allow the tent frame 3 to maintain its open and collapsed states without a locking mechanism.

One of ordinary skill in the art will recognize that other instant tent frames can be used without departing from the spirit and scope of the present invention. For example, another type of a one-touch tent frame is described in U.S. patent application Ser. No. 12/658,473 (filed on Feb. 4, 2010), which is incorporated by reference in its entirety. This one-touch frame does not require a central shaft, sub-braces or locking mechanism. The poles are pivotally connected directly to a substantially flat hub, and pivot to and from open and closed configurations without additional components. Another type of an instant tent frame is manufactured and sold as a structure similar to that of a conventional umbrella as shown, for example, in U.S. Pat. No. 6,581,617 (issued on Jun. 24, 2003). In those structures, the tent is opened and collapsed by movable sub-braces which are pivotally connected to an elongated central shaft. These structures often times have locking mechanisms on the central shaft to maintain the tent in the open state.

Figure 14:
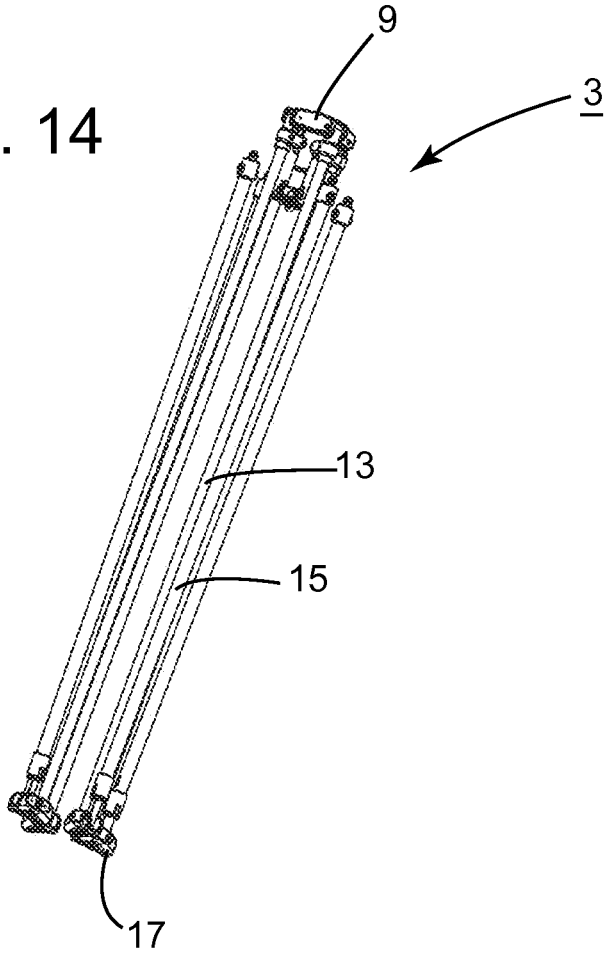
FIG. 14 is a perspective view of the frame of FIG. 2 in a collapsed configuration.

Referring to FIGS. 2 and 14, the poles 11 of the frame 3 include an upper portion 13 and a lower portion 15. The lower portion of the poles 15 include two sections that are telescopically connected such that when the frame is in the open configuration the two sections are fully extended and locked in an extended position as shown in FIG. 2, and when the frame is in the collapsed configuration one section of the pole lower portion 15 is retracted within the other section as shown in FIG. 14. The upper portion of the poles 13 are pivotally coupled to the central hub 9 on one end and pivotally coupled to the pole lower portion 15 on another end by a pivotal coupling member 17 such that when the frame 3 is in the open configuration the pole upper and lower portions 13, 15 are stably maintained as shown in FIG. 2, and when the frame 3 is in the collapsed configuration the pole lower portions 15 are pivoted about the pivotal coupling member 17 and folded inward toward the pole upper portions 13 as shown in FIG. 14.

One of ordinary skill in the art will recognize that the number of poles, the number of pole sections, as well as the folding methods of the frame could vary without departing from the spirit and scope of the invention. It is also possible to add extensions to the poles to provide more stability to the overall structure of the instant tent.

Figure 12:
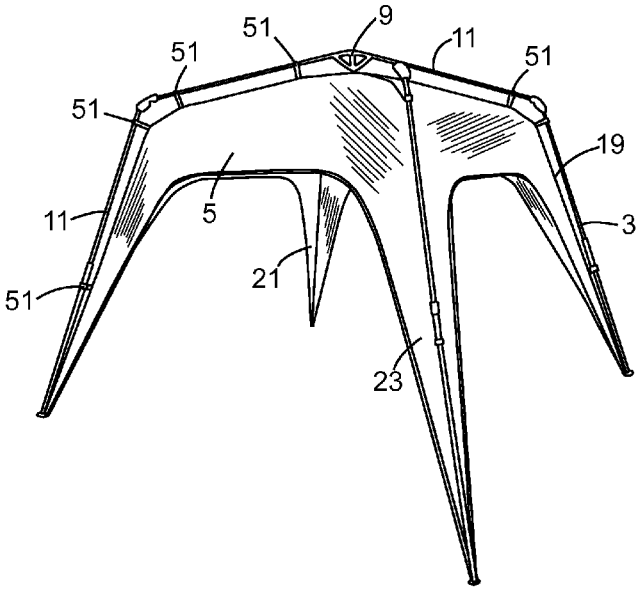
FIG. 12 is a side view of the multi-functional instant tent of FIG. 1 with the inner tent detached.

Referring to FIGS. 3 and 12, the rain fly 5 includes a plurality of sections fixedly attached together by conventional sewing or stitching methods. The adjoining sections form seams 19 which, in the preferred embodiment, generally extend along each corner of the rain fly 5 from a bottom portion to a top portion. Additional seams 19 are formed from adjoining sections on the top portion of the rain fly 5. The rain fly 5 includes an inner surface 21 and an outer surface 23. A continuous flexible adhesive tape (not shown) is applied to the seams 19 on the inner surface 21 of the rain fly 5 to prevent rain water, other liquids or debris from penetrating the rain fly 5 through the seams 19 from the outer surface 23. In the preferred embodiment, the rain fly 5 is water and flame resistant, and is a fabric constructed from materials such as cotton, polyester or nylon, or any combination thereof. The rain fly 5 can also be constructed with heat reflecting material. Other materials could be used for the rain fly 5 without departing from the spirit and scope of the invention.

Figure 11:
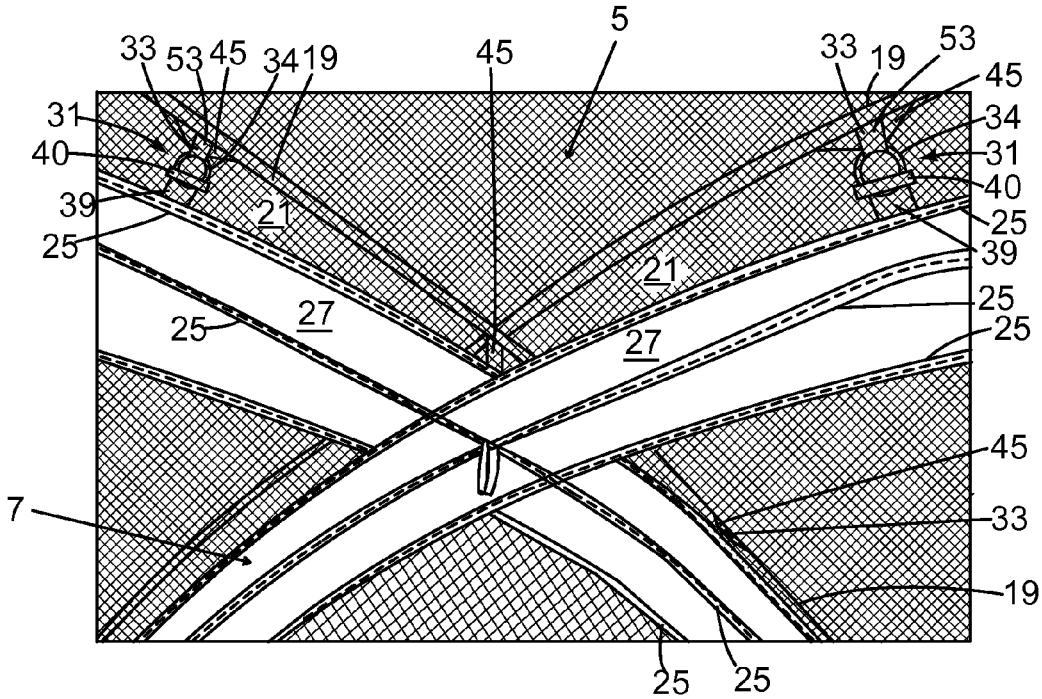
FIG. 11 is partial bottom perspective view of an upper portion of the inner tent having a partial mesh surface and rain fly.

Referring to FIG. 4, the inner tent 7 of the present embodiment also includes a plurality of sections fixedly attached together by conventional sewing methods, which forms an enclosed shelter. The adjoining sections form seams 25 which, in the preferred embodiment, generally extend along each corner of the inner tent 7 from a bottom portion to a top portion. Additional seams 25 are formed from adjoining sections on the top portion of the inner tent 7 as well as adjoining sections that form the windows and doors. In the preferred embodiment, the seams 25 of the inner tent 7 and the seams 19 of the rain fly 5 are generally aligned with and are opposite each other when the inner tent 7 and the rain fly 5 are connected, as described below. As shown in FIG. 11, an upper portion of the inner tent 7 includes a permeable portion such as mesh. The permeable portion is covered by the rain fly 5 so that constant ventilation is provided to the inner tent 7 while protecting the permeable portion from any precipitation. The inner tent 7 includes an inner surface 27 (shown in FIG. 11) and an outer surface 29. A continuous flexible adhesive tape (not shown) is applied to the seams 25 on the inner surface 27 of the inner tent 7 to prevent rain water, other liquids or debris from penetrating the inner tent 7 through the seams 25 from the outer surface 29. In the preferred embodiment, the inner tent 7 is water and flame resistant, and is a fabric constructed from materials such as cotton, polyester or nylon, or any combination thereof. The inner tent 7 can also be constructed with heat reflecting material. Other materials could be used for the inner tent 7 without departing from the spirit and scope of the invention.

Figure 5:
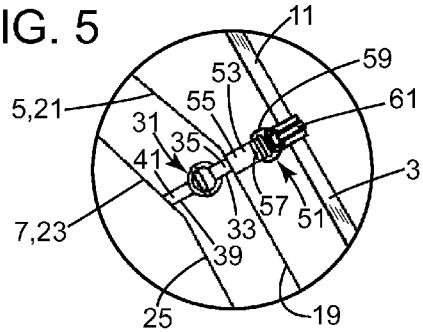
FIG. 5 is a side view of the connections between the frame, rain fly and inner tent of the multi-functional instant tent of FIG. 1, which is denoted "A" in FIG. 1.

Referring to FIGS. 3, 5, 10 and 12, the frame 3 and the rain fly 5 are coupled together by a plurality of pole engaging assemblies 51. Referring specifically to FIG. 5, each pole engaging assembly 51 includes strap 53 (which is also used for the coupling assembly 31 described below) having an inner end 55 and an outer end 57. In the preferred embodiment, the strap 53 is an elongated woven nylon material for increased strength and durability, but other materials such as bungee cord (or shock cord) could be used without departing from the spirit and scope of the present invention. The elongated woven nylon is folded substantially in half axially to form a transverse loop on the strap outer end 57 while opposing ends of the elongated woven nylon are joined together on the strap inner end 55. Other methods for forming a loop at the strap outer end 57 could be used, including folding the elongated woven nylon material such that the material only overlaps partially and fixedly attaching part of the overlapping portion, or by using multiple layers of fabric and fixedly attaching corresponding ends of the layers. Each strap 53 can also include an extension and buckle between the inner and outer ends 55, 57 for adjusting the length of each strap 53.

Referring to FIG. 5, the inner end of the strap 55 is fixedly attached, preferably by conventional sewing methods, to a seam of the rain fly 19 and extends outward toward the frame 3. Alternatively, a larger coupling extension or webbing 45 (as shown, e.g., in FIGS. 6A-7B, and described in more detail below) can be sewn into the seam of the outer surface of the rain fly 23 and the inner end of the strap 55 can be sewn onto the webbing 45 to provide additional strength and to prevent possible over-stressing that the smaller strap 55 may produce on the rain fly 5 if the strap 53 was directly coupled to the seam of the rain fly 19. A ring 59 is secured to the outer end of the strap 57 from which a pole engaging member or hook 61 extends. The hook 61 and the ring 59 are preferably formed of a tough, molded plastic but can also be constructed with other materials (such as metal) and other methods without departing from the scope of the invention. Even though the ring 59 shown in FIG. 5 is semi-circular, rings of other shapes as well as other types of attachments can be used. The hook 61 is shaped substantially similar to the poles 11 and is sized slightly larger than the poles 11 such that the hook 61 is engaged with the poles 11 in the open configuration of the instant tent 1 and slidable along the poles 11 in the closed configuration of the instant tent 1. The pole engagement assemblies 51 could be replaced by other fastening means including detachable fastener assemblies such as a hook-and-loop fastener (or Velcro®), snap-fit buttons or other hook-and-eye type fasteners, as shown in FIGS. 9A and 9B.

Figure 10:
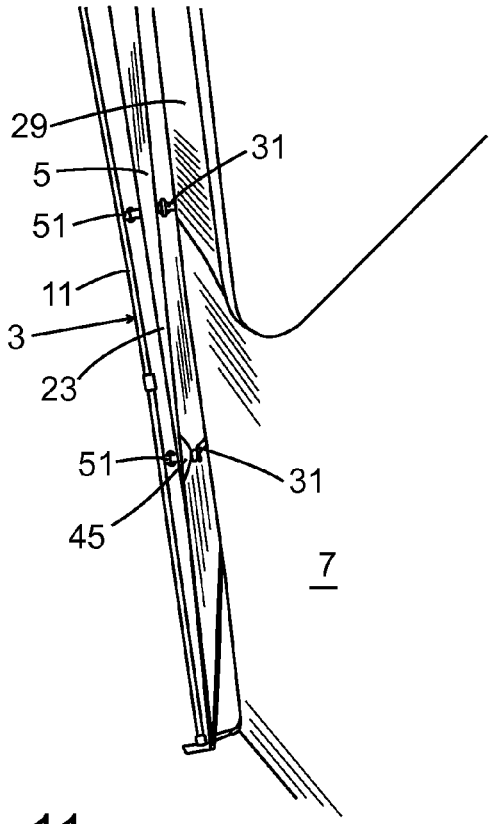
FIG. 10 is a partial perspective view of a corner of the multi-functional instant tent of FIG. 1.

Referring to FIGS. 4-7B, 10 and 11, the rain fly 5 and the inner tent 7 are coupled together by a plurality of coupling assemblies 31, each of which include a first coupling member 33 and a second coupling member 39 detachably connectable to each other. Each of the coupling assemblies 31 are sufficiently spaced apart from one another, and each of the pole engaging assemblies 51 are sufficiently spaced apart from one another. This spacing provides adequate support for the overall structure of the instant tent 1 and also ensures that the rain fly 5 and inner tent 7 are sufficiently taut when the frame 3 is fully expanded in the open configuration as shown, for example, in FIGS. 5, 10 and 11. Each coupling member 33, 39 is positioned opposite each other between the rain fly 5 and inner tent 7, along opposing seams of the rain fly and the inner tent 19, 25. Furthermore, as best shown in FIGS. 5 and 10, the positions of the coupling assemblies 31 correspond to the positions of the pole engaging assemblies 51 such that opposing tensions are exerted on the rain fly 5 at or around the same area thereby reducing the overall stress and also minimizing the number of stress points on the rain fly 5.

Figure 6A:
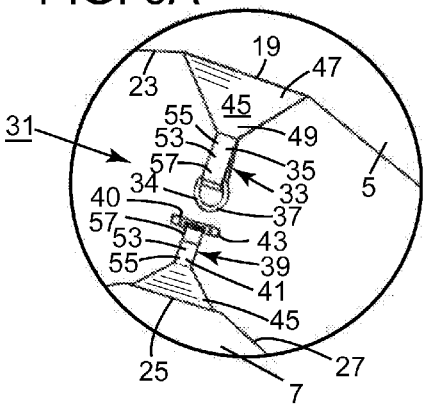
FIG. 6A is a side view of a coupling assembly in a disengaged state.
Figure 6B:
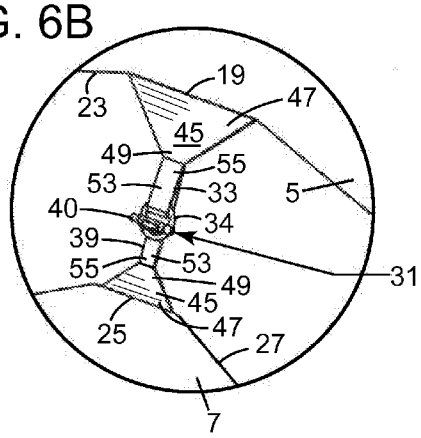
FIG. 6B is a side view of the coupling assembly of FIG. 6A in an engaged state.

Referring to FIGS. 5-6B, generally, the first coupling member 33 has a first end 35 and a second end 37, and the second coupling member 39 has a first end 41 and a second end 43. Each coupling member 33, 39 includes a strap 53 having an inner end 55 and an outer end 57 (as described above), which is disposed between the first and second ends 35, 37 and 41, 43 of each coupling member 33, 39. Each first coupling member second end 37 includes a first engaging member 34 which is permanently coupled to the strap outer end 57. Similarly, each second coupling member second end 43 includes a second engaging member 40 for detachably coupling with the first engaging member 34. One of ordinary skill in the art will recognize that the coupling assembly 31 could be configured such that the first coupling member 33 receives the second engaging member 40 and the second coupling member 39 receives the first engaging member 34 without departing from the spirit and scope of the invention.

Referring to FIGS. 6A and 6B, in one embodiment of the coupling assembly 31, the first engaging member is a circular ring 34 and is coupled to the loop of the outer end of the strap 57 of the first coupling member 33. The second engaging member is a solid cylinder 40 greater in length than the diameter of the ring 34 and includes a slit (not shown) extending axially through a center portion of the cylinder 40. The loop of the outer end of the strap 57 of the second coupling member 39 is coupled to the cylinder 40 through the slit. Referring to FIG. 6B, the coupling assembly 31 is in an engaged state when the cylinder 40 is inserted through the ring 34 so that the cylinder 40 and its corresponding strap 53 are on opposite sides of the ring 34 for a secure engagement, thus forming a hook-and-eye type of engagement. The ring 34 and cylinder 40 are preferably formed of a tough, molded plastic but can also be constructed with other materials (such as metal) and other methods without departing from the scope of the invention. This embodiment requires less material to manufacture the ring 34 and cylinder 40 and thus is particularly advantageous due to reduced manufacturing costs.

Figure 7A:
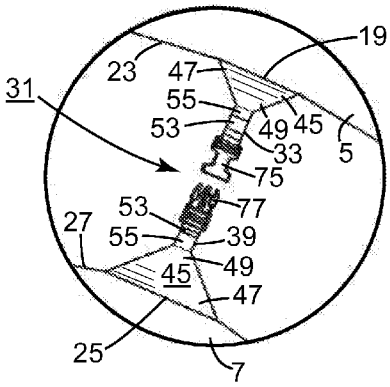
FIG. 7A is a side view of an alternative coupling assembly in a disengaged state.
Figure 7B:
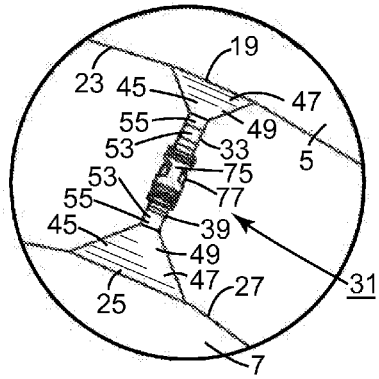
FIG. 7B is a side view of the coupling assembly of FIG. 7A in an engaged state.

Referring to FIGS. 7A and 7B, in another embodiment, the coupling assembly 31 is a buckle assembly or a side release buckle. The first engaging member is a female buckle member 75 and the second engaging member is a male buckle member 77. The female buckle member 75 consists of a center guide rod forwardly extending from the front side with two spring arms equally spaced from the center rod. The two spring arms each have a retaining block that terminates at the front end. The male buckle member 77 has a front open side and two side holes which hold and secure the two spring arms of the female buckle member 75 to form a secure engagement, as shown in FIG. 7B.

The first and second engaging members 34, 40 could be replaced by other detachable fastener assemblies such as a hook-and-loop fastener (or Velcro®), snap-fit buttons or other hook-and-eye type fasteners, as shown in FIGS. 9A and 9B.

Referring to FIGS. 8-9B, the bottom portions of the poles 11, rain fly 5 and inner tent 7 are also coupled together with the coupling assemblies 31 with a few modifications. In this embodiment, referring to FIGS. 9A and 9B, the strap inner end 55 of the second coupling member 39 extends from a bottom portion of the outer surface of the inner tent 29. As described in more detail below, the strap inner end 55 of the second coupling member 39 could be coupled directly to the inner tent outer surface 29 or to a webbing 45 extending from the inner tent outer surface 29. The strap outer end 57 of the second coupling member 39 includes a rectangular shaped ring 63 coupled with the loop of the strap outer end 57. A snap hook closure 65 is coupled to the rectangular shaped ring 63 to form the second end 43 of the second coupling member 39.

Referring again to FIGS. 9A and 9B, the strap 53 of the first coupling member 33 is formed by folding the elongated woven nylon material such that the material only overlaps partially on each end 55, 57, and each overlapping portion is fixedly attached, preferably by conventional sewing methods, to form a transverse loop on each end 55, 57. A bottom portion of the rain fly is fixedly attached to a mid-portion of the strap 53 of the first coupling member 33. A semi-circular ring 67 is coupled to the loop on the first coupling member strap outer end 57 for coupling with the snap hook closure 65 of the second coupling member 39. A pole securing member 69 having an inner end 71 and an outer end 73 is coupled to the first coupling member strap inner end 55 through a slit 75 which is formed on the pole securing member inner end 71. The pole securing member 69 includes a pole receiving hole 85 at a center portion of the pole securing member 69 for securing a bottom portion of the pole 11, and a stake hole 81 at the outer end 73 for receiving a stake (not shown) to further secure the instant tent 1 to a surface. Additional auxiliary apertures 83 are included between the pole receiving hole 85 and the inner end 71. The configuration of the pole securing member 69 is particularly unique and advantageous because the stake hole 81 is integral to the pole securing member 69 and therefore a separate component is not required to secure a stake.

Referring to FIG. 5, in one embodiment, the first ends of each of the first and second coupling members 35, 41 of each coupling assembly 31 are fixedly attached directly to the seams 19, 25 of the inner surface 21 of the rain fly 5 and the outer surface 23 of the inner tent 7, respectively.

Referring to FIGS. 6A-7B, in another embodiment, securing members or webbings 45 are used to couple the rain fly 5 with each first coupling member 33, and the inner tent 7 with each second coupling member 39. The larger webbing 45 distributes the stresses exerted on the rain fly 5 and inner tent 7 over a larger area thereby preventing possible over-stressing that the smaller first and second coupling members 33, 39 may cause on the rain fly 5 and inner tent 7, respectively, if they were directly coupled to the seams 19, 25. The webbing 45 is preferably triangular and constructed with high-strength vinyl but other shapes and materials, as well as multiple layers of fabric, could be used without departing from the spirit and scope of the present invention. Each webbing 45 includes a proximal end 47 and a distal end 49. Each proximal end 47 is fixedly attached, preferably by conventional sewing methods, to each inner surface of the rain fly 23 and each outer surface of the inner tent 27 at or near the seams 19, 25. Each distal end 49 is fixedly attached, preferably by conventional sewing methods, to the corresponding inner ends 55 of the strap 53.

As an alternative to providing more strength and durability to the areas of the inner tent 7 and the rain fly 5 having contact with the coupling assemblies 31, a high-strength fabric, such as the vinyl material used for the webbing 45, could be fixedly attached to the surfaces of the inner tent and rain fly 29, 21, and the coupling assemblies 31 could be attached directly to the high-strength fabric.

In operation, the instant tent 1 is opened to its open configuration as shown in FIG. 1, with the frame 3, rain fly 5 and inner tent 7 attached together with the coupling assemblies 31 in the engaged state. The poles 11 are extended outward such that the rain fly 5 and the inner tent 7 are substantially taut and such that the area under the rain fly 5 and the area inside the inner tent 7 are maximized. The instant tent 1 could be further secured to the surface by driving stakes (not shown) through the stake holes 81 of the pole securing members 69 shown in FIGS. 9A and 9B. In this configuration (FIG. 1), the instant tent 1 is used as a traditional tent where the inner tent 7 is an enclosed dwelling unit with the rain fly 5 providing further protection from inclement weather.

Referring to FIG. 12, when a user desires to use the instant tent 1 as an open shelter, the first and second coupling members 33, 39 of the coupling assemblies 31 are disengaged and the inner tent 5 is detached from the rain fly 7 and removed from the instant tent 1. In this configuration, the instant tent 1 is used as an open shelter while providing open air ventilation and shade.

Referring to FIGS. 13 and 14, to store and transport the instant tent 1, corresponding first and second coupling members 33, 39 of the coupling assemblies 31 are engaged and the inner tent 7 is reattached to the rain fly 5. The pole lower portions 15 are retracted and are then folded radially inward toward the pole upper portions 13 and the central hub 9 as shown in FIG. 13. The pole lower and upper portions 15, 13 are then folded radially inward into a compact, collapsed configuration as shown in FIG. 14 (only the frame 3 is shown, without the rain fly 5 and inner tent 7, for purposes of clarity).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An instant tent collapsible from an open configuration to a collapsed configuration, the instant tent comprising:

a frame comprising at least one hub and a plurality of poles extending from the at least one hub;

an outer fly having an inner surface and an outer surface, the outer fly having a top section and a plurality of side sections extending downwardly therefrom, the outer surface of the outer fly slidably coupled to the frame by a plurality of pole engaging assemblies;

an inner tent having an inner surface and an outer surface, the inner tent having a top section, a plurality of side sections extending therefrom and a bottom section connecting lower portions of said side sections, the inner surface of the inner tent defining an enclosed interior of the inner tent;

a plurality of upper coupling assemblies, each upper coupling assembly comprising a first coupling member and a second coupling member, each of the first and second coupling members having a first end and a second end, the first coupling member first end coupled to the outer fly inner surface, the second coupling member first end coupled to the inner tent outer surface, the second ends of the first and second coupling members adapted to be detachably coupled to each other; and a plurality of lower coupling assemblies, each lower coupling assembly comprising:

an inner member having an inner end and an outer end, said inner end fixedly coupled to a lower portion of the inner tent;

an outer member having an inner end and an outer end, said inner end detachably coupled to the inner member outer end, a lower portion of the outer fly fixedly coupled to the outer member between the inner and outer ends of the outer member; and a pole engaging member having an inner end and an outer end, the pole engaging member inner end coupled to the outer member outer end, a pole orifice disposed between the inner and outer ends of the pole engaging member, a lower end of a corresponding pole secured within the pole orifice;

wherein the frame, outer fly and inner tent remain coupled together in the collapsed configuration.

2. The instant tent according to claim 1, wherein at least one upper coupling assembly is selected from a group comprising a buckle assembly, a pair of hooks, a hook-and-loop fastener, a hook-and-eye closure or snap-fit buttons.

3. The instant tent according to claim 1, wherein at least one of the first and second coupling members comprises an adjustable strap disposed between respective first and second ends.

4. The instant tent according to claim 1, wherein the first end of at least one of the first and second coupling members comprises a reinforcing member.

5. The instant tent according to claim 1, wherein each outer fly side section is substantially open.

6. The instant tent according to claim 5, wherein in the open configuration the first and second ends of each upper coupling assembly and the inner and outer ends of each lower coupling assembly are separately engaged to form an inner tent with an outer fly; and the first and second ends of each upper coupling assembly and the inner and outer ends of each lower coupling assembly are separately disengaged and the inner tent is removed to form a substantially open shelter.

7. The instant tent according to claim 1, wherein each upper coupling assembly and corresponding pole engaging assembly are substantially aligned.

8. The instant tent according to claim 1, wherein the inner member, outer member and pole engaging member of each lower coupling assembly are substantially aligned.

9. An instant tent collapsible from an open configuration to a collapsed configuration, the instant tent comprising:

a frame comprising at least one hub and a plurality of poles extending from the at least one hub, an outer fly having an inner surface and an outer surface, the outer fly comprising a plurality of sections fixedly attached together, a first set of seams formed between said fixed plurality of sections, the outer surface of the outer fly slidably coupled to the poles of the frame along the first set of seams;

an inner tent having an inner surface and an outer surface, the inner tent comprising a plurality of sections fixedly attached together, a second set of seams formed between said fixed plurality of sections, the inner surface of the inner tent defining an enclosed interior of the inner tent, a plurality of upper coupling assemblies, each upper coupling assembly detachably connecting the inner surface of the outer fly and the outer surface of the inner tent at portions of the first and second sets of seams, respectively; and a plurality of lower coupling assemblies, each lower coupling assembly comprising:

an inner member having an inner end and an outer end, said inner end fixedly coupled to a lower portion of the inner tent;

an outer member having an inner end and an outer end, said inner end detachably coupled to the inner member outer end, a lower portion of the outer fly fixedly coupled to the outer member between the inner and outer ends of the outer member; and a pole engaging member having an inner end and an outer end, the pole engaging member inner end coupled to the outer member outer end, a pole orifice disposed between the inner and outer ends of the pole engaging member, a lower end of a corresponding pole secured within the pole orifice;

wherein in the open configuration the first and second coupling members of each upper coupling assembly and the inner and outer members of each lower coupling assembly are separately engaged to form an inner tent with an outer fly; and the first and second coupling members of each upper coupling assembly and the inner and outer members of each lower coupling assembly are separately disengaged and the inner tent is removed to form a stand-alone shelter.

10. The instant tent according to claim 9, wherein each upper coupling assembly comprises a first coupling member and a second coupling member, each of the first and second coupling members having a first end and a second end, each first coupling member first end coupled to the outer fly inner surface, each second coupling member first end coupled to the inner tent outer surface, the second ends of the first and second coupling members adapted to be detachably coupled to each other.

11. The instant tent according to claim 10, wherein at least one upper coupling assembly is selected from a group comprising a buckle assembly, a pair of hooks, a hook-and-loop fastener, a hook-and-eye closure and snap-fit buttons.

12. The instant tent according to claim 10, wherein at least one of the first and second coupling members comprises an adjustable strap disposed between respective first and second ends.

13. The instant tent according to claim 10, wherein the first end of at least one of the first and second coupling members comprises a reinforcing member.

14. The instant tent according to claim 9, wherein the frame, outer fly and inner tent remain coupled together in the collapsed configuration.

15. The instant tent according to claim 9, wherein the inner member, outer member and pole engaging member of each lower coupling assembly are substantially aligned.

* * * * *